US005283835A

United States Patent [19]

Athanas

[11] Patent Number: 5,283,835

[45] Date of Patent: Feb. 1, 1994

[54] FERROELECTRIC COMPOSITE FILM ACOUSTIC TRANSDUCER

[76] Inventor: Lewis S. Athanas, 240 Middle St., West Newbury, Mass. 01985

[21] Appl. No.: 792,581

[22] Filed: Nov. 15, 1991

[51] Int. Cl.[5] ..... H04R 25/00

[52] U.S. Cl. ..... 381/190; 381/191; 381/173; 310/324

[58] Field of Search ..... 381/173, 190, 191, 192; 310/324, 328, 330, 334; 29/594, 609.1

[56] References Cited

U.S. PATENT DOCUMENTS

| | | | |
|---|---|---|---|
| 4,056,742 | 11/1977 | Tibbetts | 381/173 |
| 4,156,800 | 5/1979 | Sear et al. | 381/173 |
| 4,322,877 | 4/1982 | Taylor . | |
| 4,409,510 | 10/1983 | Assenza et al. | 310/334 |
| 4,578,613 | 3/1986 | Boer et al. | 381/190 |
| 4,638,207 | 1/1987 | Radice . | |
| 4,843,275 | 6/1989 | Radice | 381/190 |

OTHER PUBLICATIONS

Edelman S. et al., Forum Comments on "Electroacoustic Transducers with Piezoelectric High Polymer Films" pp. 577-578.

Tamura, M. et al., "Electroacoustic Transducers With Piezoelectric High Polymer Films", Sep. 1974, pp. 21-25, in *Journal of the Audio Engineering Society,* Jan.-/Feb. 1975, vol. 23, No. 1.

Garner, G. M. et al., "A New Microphone for Telephone Handsets", Nov. 1977, pp. 22-27 in *Systems Technology,* Nov. 1977, No. 27.

Marcus, M. "Ferroelectric Polymers and Their Applications", Aug., 1981, Fifth International Meeting on Ferroelectricity at Pennsylvania State University.

Locanthi, B. et al., "Development of a Loudspeaker System with Omni-Directional Horn Loaded with Polymer Tweeter", pp. 1-5 and FIGS. 1-16.

*Primary Examiner*—Jin F. Ng
*Assistant Examiner*—Huyen D. Le
*Attorney, Agent, or Firm*—Dike, Bronstein, Roberts & Cushman

[57] ABSTRACT

An acoustic transducer is formed by a rigid substrate and a strip of a laminated sheet material including an intermediate layer of a ferroelectrical material sandwiched between inner and outer layers of a conductive material. Two lines of conductive epoxy supply an AC signal across the full height of the inner and outer layers. The ferroelectric layer is preferably a piezoelectric plastic such as PVDF with a preferred direction of displacement oriented laterally across the strip. The strip is preferably secured in a groove in the substrate by a cement having acoustical properties closely matching those of the strip and the substrate. The strip is curved in a parabola by its own tension. The strip is sufficiently stiff to be self supporting without the use of a foam or rubber backing layer. The conductive layers are preferably each a layer of copper overlayed with a layer of nickel. The substrate preferably includes a sound chamber mounted on its back side opposite the strip and has a set of holes to transfer sound energy to the chamber. The material forming the substrates has a speed of sound closely matching that of the strip, but preferably slightly less. The substrate material is also lossy to dampen the acoustical energy.

21 Claims, 2 Drawing Sheets

FERROELECTRIC COMPOSITE FILM ACOUSTIC TRANSDUCER

BACKGROUND OF THE INVENTION

This invention relates in general to acoustic transducers and more specifically to a high quality speaker where the diaphragm is its own driver.

Conventional speakers for radios, televisions, musical performances, and home hi-fidelity sound systems typically use a cone diaphragm of a flexible sheet material driven at its apex by an electromagnetic coil or a crystal. By selecting the size, shape, material, and mounting of the diaphragm it is possible to tailor the performance of the speaker within wide ranges of performance standards and costs. However, to obtain high quality acoustical performance it is necessary to use materials and techniques that are associated with a high cost. High quality speakers are usually characterized by a low input impedance, large driving currents, and sensitivity to temperature and humidity variations. For example, very light diaphragms are best for high frequency response, but they are difficult to mount and they are sensitive to atmospherics. At the lower performance end, such as conventional automobile and household radio speakers, reduced cost and ruggedness of design are emphasized at the expense of acoustical performance.

Recognizing the limitations of the diaphragm and magnetic drive approach, attempts have been made to drive a diaphragm with piezoelectric crystals. The Motorola company, for example, manufactures a ceramic tweeter formed of barium titinate. Such crystals are also used in microphones and ultrasonic humidifiers.

It is also known to use sheets of a ferroelectric material as a transducer where an applied electrical signal produces a displacement of the ferroelectric material that in turn produces sound waves in the surrounding air, or vice versa. Polyvinyledieneflouride (PVDF) is a dense plastic that exhibits a piezoelectric effect. It is also known to metallize sheets of such a material that have been stretched (in one or more directions), charged (e.g. at 5 KV), and then cooled. The materials, when cooled and shrunk, retains a charge. It expands in the stretched direction in response to an applied positive voltage and contracts in response to an applied negative voltage, also in the stretched direction. Metalized sheets of such ferroelectric materials have been used by Syrix Innovation of Straham, England in contact microphones. Small, dime sized pieces of such a material have been used in ultrasonic humidifiers. Sheets of the material have been used on the hulls of boats to vibrate off material clinging to the hull.

In speaker applications, there have been attempts to use ferroelectric sheets. Heretofore, when the ferroelectric material is used, a foam or resilient backing has been employed to provide structural rigidity. It may also be edge-mounted in a plastic frame. While the frame supports the sheet, it also impedes its movement in response to the applied signal. Also herefore the sheet material has been used with a cylindrical curvature.

Some specific examples of prior attempts to use ferroelectrics include a cylindrical speaker manufactured by Pioneer Electronics. It uses a layer of PVDF laminated on a metal plate. The speaker of this design burned out. With a foam backing it was possible to reach the top two octaves, but the construction would rattle at a low resonant frequency. A novelty item was produced by Pennwalt, a "talking balloon" formed by bonding a metalized PVDF composite onto a rubber backing in the form of a balloon. This construction, however, is not capable of sound reproduction of a quality suitable for ordinary radios, let alone high quality sound systems.

It is therefore a principal object of the present invention to provide a ferroelectric acoustic transducer which uses no magnetic or ceramic driver, exhibits excellent sound quality and is easily driven with no danger of burn out.

Another principal object of this invention is to provide a transducer with the foregoing advantages which has a low cost of manufacture.

A further object of this invention is to provide a transducer with the foregoing advantages which has a low input impedence and low power requirements.

A still further object is to provide a speaker with the foregoing advantages that exhibits a substantially flat response over a broad frequency band normally associated with high quality acoustical speakers.

Yet another object is to provide a transducer with the foregoing advantages that is stable, particularly in response to variations in atmospherics such as temperature and humidity.

Another object of the present invention is to produce a cylindrical sound wave output using essentially a line source.

Still another significant object of the invention is to provide all of the foregoing advantages with a high degree of safety and with a high level of ruggedness.

A further object is to provide a loudspeaker with all of the foregoing advantages that is physically compact and lightweight.

SUMMARY OF THE INVENTION

An acoustic transducer includes a substrate formed of an insulating material and a strip of a ferroelectric sheet laminate held on the substrate, preferably with its longitudinal edges seated in a longitudinally extending groove formed in one face of the substrate. The strip has an intermediate layer of a ferroelectric material such as PVDF. Its preferred direction of displacement is oriented across the groove in the substrate transverse to the longitudinal axis. The strip also has inner and outer layers of a malleable conductive material bonded to the ferroelectric intermediate layer. These conductive layers are preferably each composite layers of copper with an overlying layer of nickel to control oxidation. When mounted on the groove, the strip is curved away from the substrate, preferably in a parabolic configuration when viewed in cross section in a plane perpendicular to the longitudinal axis.

The strip is preferably secured to the substrate with a cement such as polyurethane having acoustical transmission properties that match those of the strip and the substrate to reduce reflections at the strip-substrate interface due to impedance mismatching. In turn, the substrate is preferably formed of a material such as a phenolic resin that transmits sound energy at a slightly slower velocity than the strip material to produce a substantially coherent, non-distorted sound wave in response in an applied electrical signal. The substrate is also preferably acoustically lossy to damp sound energy not radiated by the strip away from the substrate. The transducer also includes line conductors such as strips of a conductive adhesive extending longitudinally along the full length of each said inner and outer conductive layers. The conductors are preferably at opposite lateral edges to reduce localized electrical heating of the strip and reduce the chance of arcing through the laminate. These line conductors apply the electrical signal to the conductive layers to produce a corresponding voltage across the ferroelectric layer and, in turn, a corresponding physical displacement of the strip.

The strip is self-supporting when mounted on the substrate. The tension in the strips itself due to its curvature makes it self-supporting. No backing layers of foam, stiff metal sheets, or stiff circumferential mountings are required. The strip is also self-driven; there is no separate electromagnetic coil drive or piezoelectric crystal drive. The strip acts as a diaphragm and driving element in one. This effect is best achieved when the strip has a curvature that is parabolic. The thickness, radius, and area of the strip determine the efficiency and quality of the sound output.

In a preferred form for use as a loudspeaker, a sound chamber is mounted on the rear face of the substrate, opposite the strip, and holes are provided in the substrate to facilitate the transfer of acoustical energy between the sound chamber and the region under the strip. The sound chamber can be a semi-cylindrical tube with its upper and lower ends half plugged, or a more conventional rectilinear wooden box. The volume of the chamber can be comparatively small; it is only necessary to absorb rearwardly directed sound energy. Alternately, it may be useful to eliminate the back chamber, creating a dipole radiation pattern.

When used as a loudspeaker, the transducer can be driven by a conventional amplifier feeding the transducer through a preliminary network consisting of a signal pole low pass filter, and a transformer. The preliminary network may also include a high frequency trap. Also, the substrate can mount multiple strips that have the same frequency response, or are constructed to maximize their acoustical output over differing bandwidths to produce a composite output. It is also within the scope of the present invention to mount a conventional woofer in the substrate to provide a low frequency output.

These and other features and objects of the present invention will be more fully understood from the following detailed description which should be read in light of the accompanying drawings.

BRIEF DESCRIPTION OF THE DRAWINGS

FIG. is detailed view in horizontal section of the composite ferroelectric strip shown in FIGS. 1–3.

DETAILED DESCRIPTION OF THE PREFERRED EMBODIMENTS

Figure 1:
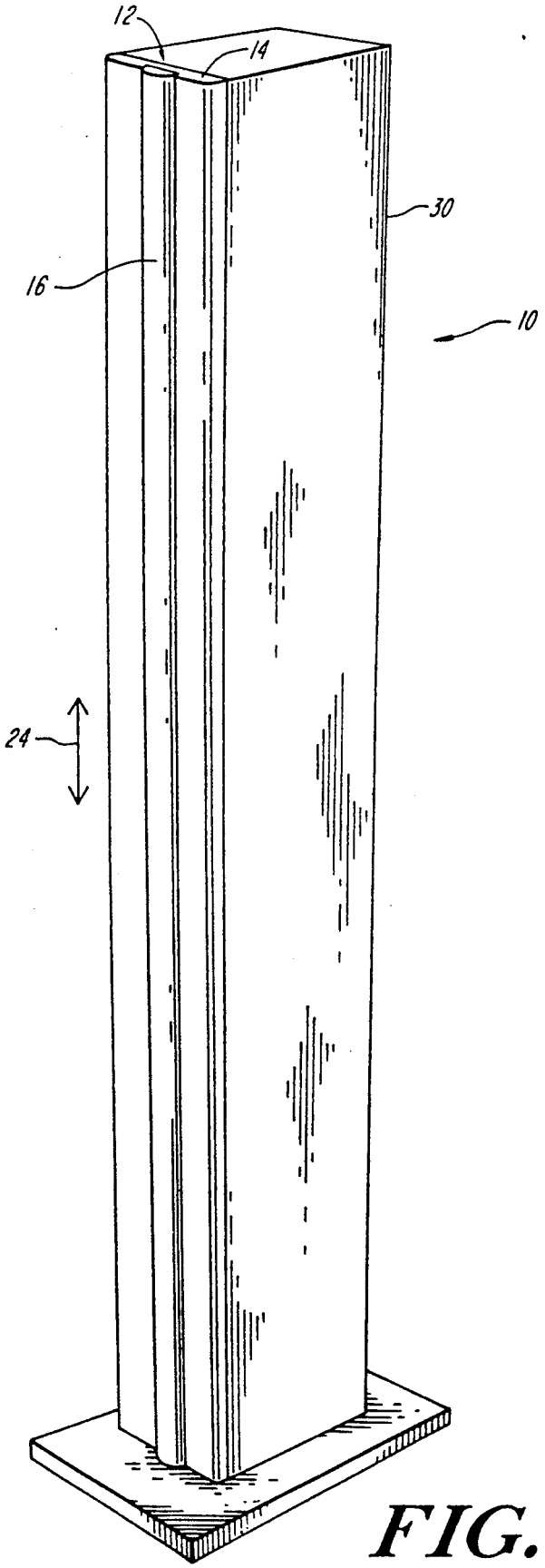
FIG. 1 is a view in perspective of home-entertainment of a speaker according to the present invention.
Figure 2:
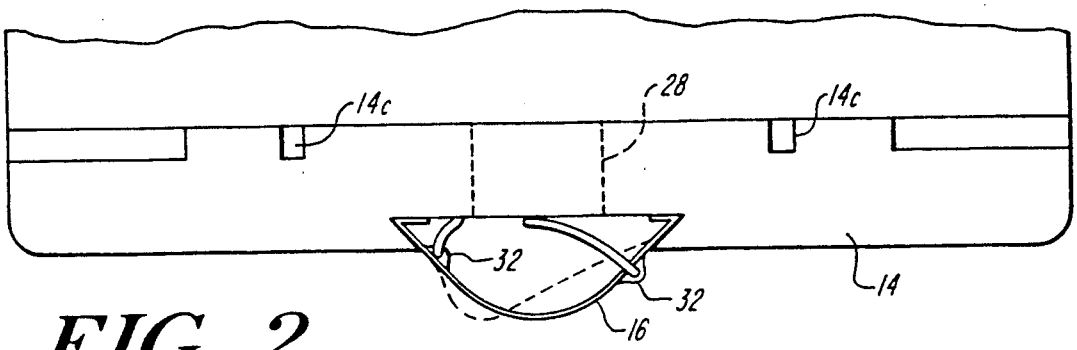
FIG. 2 is a view in horizontal section of the acoustic transducer of the speaker shown in Fig. 1.
Figure 3:
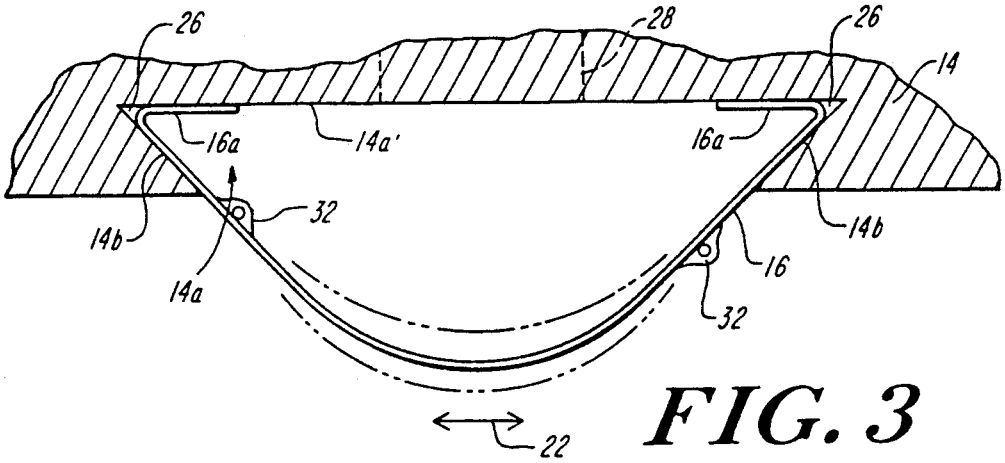
FIG. 3 is a detailed view in horizontal section of the laminate ferroelectric strip shown in FIGS. 1 and 2.
Figure 5:
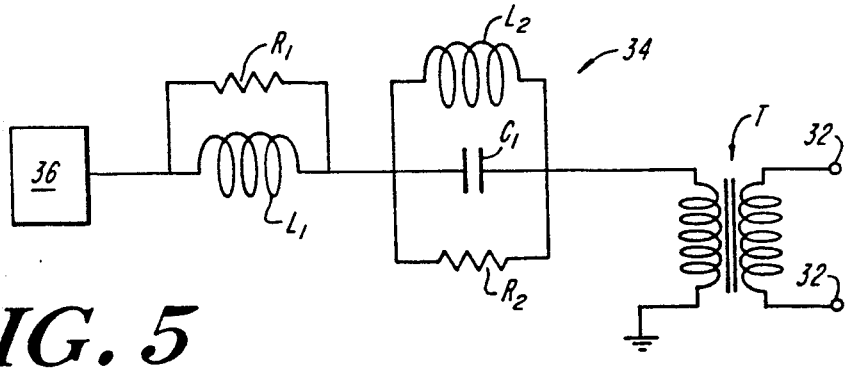
FIG. 5 a circuit diagram of an electrical power system for the speaker shown in FIGS. 1–4.

A speaker 10 suitable for use with a home high fidelity sound system includes an acoustic transducer 12 according to the present invention. The transducer 12 has a substrate 14 and a strip 16 of laminate construction that is edge mounted along its two longitudinal edges in a groove 14*a* formed in one face of the substrate. The strip is curved away from the substrate in a generally parabolic curve as is best seen in FIGS. 2 and 3. The strip has an intermediate layer 18 of a ferroelectric material, preferably a polyvinyledieneflouride (PVDF) sold by the Pennwalt company under the trade designation Kynar. PVDF is a dense plastic which can be metallized, stretched, charged, and then cooled to retain a charge. The Kynar brand PVDF when so treated exhibits ferroelectric properties, that is, if a positive voltage is applied across it is expands in the direction of the stretching (which may be more than one direction). A negative applied voltage induces a contraction, also along the direction of the stretching. While metallization of such materials is known, applicant is not aware of strips of such material that has been metallized on both surfaces and used as acoustic transducers, or metallized in the manner of the present invention.

Applicant's strip 16 includes inner and outer conductive layers 20, 20. These layers are preferably thin, malleable and metallic, but they can be non-metallic, such as a conductive (silver) epoxy of suitable characteristics. The conductive epoxy is more expensive that the preferred metallic layers. As shown, each layer 20,20 is formed by two layers, a layer 20*a* of copper bonded directly to the ferroelectric layer and an overlaying layer 20*b* of nickel that is bonded onto the copper. This construction meets the many and sometimes competing, design criteria of this layer. First, the metals are good conductors and therefore conduct the applied electrical signal over their full surface. Second, they are sufficiently malleable that they can undergo the mechanical stresses as the ferroelectric layer expands and contracts without cracking, or delamination, or introducing sufficient rigidity that it is difficult to drive the layer 18. Third, the metals can be applied in very thin layers to avoid a mass loading that would distort the displacement of the layer 18 in response to the applied electrical signal. Fourth, they bond well to the ferroelectric layer and to each other. Fifth, with a layer thickness thin enough to provide the foregoing operational characteristics, the layers 20, 20 nevertheless provide sufficient structural stability that the strip is self supporting; it requires no foam or like backing member. Sixth, the layers 20, 20, while malleable, also damp oscillation of the layer 18 so that the acoustic output of the strip follows the applied electrical signal. Seventh, the thermal conductivity of the layers 20, 20 provides good temperature stability (changes of less than 2 dB over a temperature range of 0° F. to 110° F.) and dissipate thermal energy to avoid hot spots.

By way of contrast, strips formed of aluminum bonded on PVDF soon exhibited cracks and performed poorly. Copper alone performs well, but the nickel layer 20*b* has the added advantages that it protects the copper layer from oxidation and it appears to help significantly with respect to temperature stability. By way of illustration, but not of limitation, a layer 18 of PVDF that has a thickness of 28 microns is coated with a layers 20*a*, 20*a* of copper each having a thickness of about 1.0 micron, and an overlying layer of nickel having a thickness of 1.0 micron. The total thickness of the laminate from the strip 16 is then run about 32 microns.

The metallic layers 20, 20 are preferably coextensive with the parabolic surface of the layer 18 which is free to move in response to the applied electrical signal. This avoids a displacement of the layer 18 at the interface with the substrate and to reduce the likelihood of arcing between the layers 20, 20. The stretch direction of the PVDF is indicated by arrow 22. It is generally lateral, across the groove 14a and perpendicular to the longitudinal axis 24 of the strip 16. Displacements of the layer 18 therefore produces a pattern of displacement of the strip that is non-circular, with the largest net displacement at the center of the strip, while producing a generally cylindrical sound wave extending from what is essentially a line source of sound energy.

The substrate 14 is preferably formed of an insulating material that has a speed of sound transmission that this close to, but slightly slower than that of the material used for the layer 18. For a Kynar brand PVDF, a phenolic resin laminate is a suitable material. As shown, the substrate is an elongated member with a generally rectangular cross section. The groove 14a has a flat rear wall 14 a' and inwardly flaring side walls 14b, 14b. As shown, they are inclined at 45° with respect to the rear wall 14a'. The side walls capture the folded lateral, longitudinally extending edges 16a, 16a of the strip 16. The mounting of the strip also includes securing the edges 16a, 16a in the groove using fillets of cement 26, 26 at the corners formed by the walls 14b and the rear wall 14a'. The cement should firmly and reliably bond to the ferroelectric layer and to the material forming the substrate. It should also be insulating. But it is also important that it have acoustical properties closely matching those of the ferroelectric material and the substrate in order to match acoustic impedance seen by sound waves produced in the layer 18 and traveling to the cement 26, 26 and the substrate 14. Impedance mismatches will produce reflections at the material interferences that detract from the sound quality produced by the transducer. A suitable cement 26 is a polyurethane such as the product sold by Ciba-Geiqy under the trade designation Arathane.

The substrate 14 can include a set of holes 28 that extend through its rear wall 14a'. The holes 28 transmit the rearwardly directed acoustical energy of the oscillating strip 16 to a sound chamber 30 mounted on the substrate directly behind the strip 16. The sound chamber holds a volume of air that attenuates this rearwardly directed energy. This reduces distortion due to reflections of this energy from the wall 14a back to the strip 16 or transmission of the energy through the substrate. The sound chamber can assume any of a wide variety of constructions depending on the bandwidth desired to be dampened, size constraints and the aesthetics of the exterior appearance. In one form it can be a relatively small semi-cylindrical tube with its longitudinally extending edges seated in a pair of rectangular qrooves 14c, 14c on the substrate. The upper and lower ends of this chamber are preferably partially plugged. In another form the sound chamber 30 is a generally rectangular wooden cabinet with the substrate 14 forming one side of the cabinet and producing an enclosed air mass communicating with the strip 16 through the holes 28.

Lines 32, 32 of a conductive adhesive provide an electrical connection to the conductive layers 20,20. The conductive adhesive can be any of well known such products. Each line extends longitudinally along the full height of an associate one of the layers 20. The lines 32, 32 are preferably located adjacent opposite lateral edges 16a, 16a of the strip, as shown in FIGS. 2 and 3, to reduce the possibility of arcing through the strip or the generation of localized hot spots. (In operation, the lines 32, 32 are not directly opposite one another as suggested by FIG. 4.) While it is not essential that the line extend the full longitudinal height of the layer 20, this arrangement is preferred since it facilitates the transmission of the signal to the layer, reduces electrical resistance as component to a spot connection, and provides a uniform mass loading on the strip along its full length to enhance the uniformity of its response to the applied electrical signal over its surface. Moreover, if the conductive layers 20,20 develop cracks, they normally will occur straight across the strip. Therefore by having a conductor external the full length, no crack will interrupt the flow of the electrical signal and isolate a portion of the strip. Such isolation will eventually destroy the strip due to difference in displacements of the strip in adjacent regions.

Figure 4:
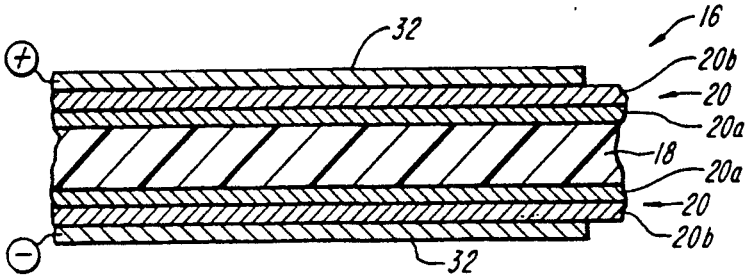

FIG. 4 shows a preliminary network 34 connected between an amplifier 36 and the transducer 12. The amplifier 36 is any conventional amplifier suitable for the particular transducer application. For a home high fidelity sound system, it can be any commercially available receiver or amplifier. However, because the impedance of the transducer 12 is low and it has low power requirements, as compared to conventional electromagnetically driven speakers or the like, it can have a lower power output, and in general a lower cost. The amplifier output is first fed through a single pole low pass filter consisting of a resistor $R_1$, and an inductor $L_1$, in parallel. The filtered output is then directed to a high frequency trap consisting of an inductor $L_2$, a capacitor $C_1$ and a resistor $R_2$, all connected in parallel with one another. Finally, the signal is directed to a step down transformer T which is connected to the conductive lines 32, 32. The low pass filter determines the lowest frequence passed to the transducer. It trades bandwidth, typically cut off at 400 Hz, for efficiency. By way of illustration, to drive a transducer 12 having a height of about 40 inches, a width of about 1 inch, a maximum lateral spacing from the rear wall 142' of about 0.25 inch, a surface area of about 40.0 square inches, and a capacitance of about 0.05 $\mu$f, the amplifier 46 has a maximum power output of 100 watts RMS, the resistor $R_1$, is 6 ohms, the inductor $L_1$ is 2.4 mh, the inductor $L_2$ is about 0.04 mh, the capacitor $C_1$ is the range of 2 to 3 $\mu$f and the resistor $R_2$ is 2.7 ohms. The step-up transformer ratio is 18:1.

The curvature, radius, thickness and area of the strip are the principal variables which control the efficiency and quality of its sound output, other factors such as the materials, substrate mounting and electrical connections being constant. The parabolic configuration has been found to be important in producing a transducer which can cope with the stress of the air loading on the strip as it oscillates. (Heretofore, it was thought that a semicircular configuration was required.) Another key difference between the present transducer and conventional transducer is that normally the operating bandwidth is selected to lie above the resonant frequency of the transducer. In the present case, the opposite is true. The thin, highly flexed strip has an extremely high resonant frequency, typically in excess of 20,000 Hz. Therefore the operating bandwidth is below the resonant frequency.

The output efficiency of the transducer 12 is principally a function of the strip curvature, total surface area and strip thickness. The larger the radius of curvature, the larger the output efficiency. The same is true of surface area. Decreasing the thickness increases the output. Output quality is principally dependent on curvature and thickness. Decreasing the radius increases the resonant frequency and decreases even order distortion. Decreasing thickness increases the resonant frequency and decreases the "Q" or "sharpness" of the resonance. It also decreases the ability of the strip to be self supporting. In particular, it enhances the tendency of the strip to go into a "wobble" or lateral bell-mode unstability (dashed line in FIG. 2).

The transducer 12 presents a capacitive load, however it is quite small, a typical value for a home loudspeaker of the type delineated above is about 1/20 ohm. By placing an inductor in series with this capacitive load it is possible to present a load to the amplifier which is substantially resistive, that is, purely ohmic. This resulting electrical roll-off of about 6 dB/octave yields the extremely flat acoustic response noted above.

It should be noted that the very low current (e.g. 0.2 amperes) required to drive the transducer 12 at 500 volts provides a very safe speaker. If a person were to puncture the transducer to the conductors the risk would be an electrical shock about on a par with a static electric discharge from a rug or clothing in winter. Also, the transducer is lightweight, compact and readily manufactured. There are no heavy permanent magnets, coils, mountings or other components which contribute substantially to the weight of conventional good quality high fidelity speakers.

The speaker 10 can use a single strip 16, or multiple strips 16 mounted either on a common or on separate substrates. It is also possible to use a strip 16 and a conventional woofer for the low frequency end of the audible spectrum, e.g., below 400 Hz. Multiple strips can be "tuned" to optimize this performance with different bandwidths. For example, a strip with a surface area four times larger than discussed above (e.g. about 160 sq. inches) can lower the low end cut off by about one octave. In checking the area using multiple ones of these strips can form a woofer. The transducer 12 can also be used for headphones, automobile radio speakers (particularly in view of its excellent thermal response), loudspeakers, public address systems, television, telephones, microphones or any application where it is desired to convert an electrical signal into sound energy, or vice versa. It should be noted that when used without a sound chamber 30, the speaker 12 is extremely flat and lightweight and therefore conducive to wall mounting in a residence.

There has been described a transducer that utilizes no separate driver such as an electromagnetic coil or a piezoelectric crystal and which can produce an extremely high quality sound output with high efficiency requiring a low power input. The device has a low cost of manufacture as compared to comparable conventional equipment, is reliable, safe and substantially insensitive to atmospheric changes. The transducer is compact, lightweight and can operate over a wide bandwidth.

While the invention has been described with respect to its preferred embodiments, it well be understood that various modifications and alterations will occur to those skilled in the art from the foregoing detailed description and the accompanying drawings. For example, while the invention has been described principally with respect to a ferroelectric laminate strip having a transverse parabolic curvature, it is possible to use other curvatures such as an arc of a circle, albeit with decreased efficiency and performance. And while the strip has been described with reference to bimetalic conductive layers, it is possible to use single metal layers and layers of sprayed-on conductive epoxies, e.g., flexible, silver bearing conductive epoxy, albeit at greatly increased cost. A variety of mounting arrangements for the strip are possible other than a single piece of a phenolic resin laminate, provided that the mounting supports the strip and is acoustically matched to it to receive and dampen sound energy transmitted from the strip. Likewise various other arrangements can be used to introduce the electrical signal to the strip, or to mount the strip on the substrate. These and other modifications and variations are intended to fall within the scope of the appended claims.

What is claimed is:

1. An acoustic transducer that converts between electrical energy and acoustical energy comprises, a substrate, a strip of a sheet material held on said substrate along its longitudinal edges only and is spaced from and curves away from said substrate viewed in a plane perpendicular to said longitudinal edges in the form of a parabola created by the tension in the strip itself, said strip including an intermediate layer of a ferroelectric material and outer layers of a conductive material extending over both faces of said intermediate layer, and said ferroelectric material having a preferred direction of displacement in the presence of said electrical energy applied across said outer conductive layers where the direction of displacement is transverse to the longitudinal axis of said strip, and means for securing said strip to said substrate at said longitudinal edges only.

2. The transducer of claim 1 wherein said ferroelectric layer is a piezoelectric plastic.

3. The transducer of claim 2 wherein said conductive layer comprises a coating of copper.

4. The transducer according to claim 2 wherein said outer coatings comprise a conductive epoxy.

5. The transducer according to claim 1 wherein said substrate is a rigid structural material having acoustical characteristics that generally match those of said strip.

6. The transducer of claim 5 wherein said means for securing comprises an adhesive having acoustical properties matching those of said strip and said substrate to match acoustical impedances and to minimize reflections of the transmission of sound energy.

7. The transducer of claim 5 wherein said substrate transmits sound at a speed substantially the same as the said strip.

8. The transducer of claim 7 wherein said substrate transmits sound at a speed slightly lower than the speed of sound in said strip.

9. The transducer of claim 5 or 8 wherein said substrate is formed of a phenolic resin.

10. The transducer of claims 7 or 9 wherein said substrate is formed of the same material as said intermediate layer.

11. The transducer of claim 1 further comprising means for connecting said electrical energy to said strip.

12. The transducer of claim 11 wherein said connecting means includes a conductive member secured to said outer layers and extending generally the full length of said strip.

13. The transducer of claim 12 wherein said conductive members are lines of a conductive adhesive in electrical connection with said outer layer.

14. The transducer according to claim 1 wherein said substrate is an integral single member that spans said strip and further comprising a sound chamber disposed on the opposite side of said substrate from said strip and means for facilitating the transfer of acoustical energy between said sound chamber and the region between said strip and said substrate.

15. The transducer according to claim 14 wherein said sound chamber is partially plugged at its longitudinal ends.

16. The transducer according to claim 1 wherein the thickness of said strip and its radius of curvature produce a resonant frequency in the high frequency range well above the operating bandwidth of the transducer.

17. The transducer according to claim 1 wherein said substrate has a longitudinally extending groove with inwardly flaring side walls that receives said strip.

18. The transducer according to claim 1 wherein said substrate holds a plurality of said strips.

19. The transducer according to claim 1 further comprising a woofer mounted on said substrate to enhance the low frequency response of the transducer.

20. An acoustic transducer that converts between electrical energy and acoustical energy comprising, a substrate, a strip of a sheet material held on said substrate along its longitudinal edges and is spaced from and curves away from said substrate viewed in a plane perpendicular to said longitudinal edges, said strip including an intermediate layer of a piezoelectric plastic and outer layers of a coating of copper extending over both faces of said intermediate layer, said outer layers including a layer of nickel overlying each of said copper coatings, and said ferroelectric material having a preferred direction of displacement in the presence of said electrical energy applied across said outer conductive layers where the direction of displacement is transverse to the longitudinal axis of said strip, and means for securing said strip to said substrate at said longitudinal edges.

21. The transducer of claim 20 wherein said curvature of said strip is in the form of a parabola created by the tension in the strip itself.

* * * * *